US006140986A

United States Patent [19]

Wilkinson et al.

[11] Patent Number: 6,140,986

[45] Date of Patent: Oct. 31, 2000

[54] COMBINED MONOCHROME AND COLOR DISPLAY

[75] Inventors: Dean A. Wilkinson; James J. Cathey, both of Boise, Id.

[73] Assignee: Micron Technology, Inc., Boise, Id.

[21] Appl. No.: 08/799,546

[22] Filed: Feb. 13, 1997

[51] Int. Cl.[7] ..... G09G 3/22

[52] U.S. Cl. ..... 345/74.1; 345/151

[58] Field of Search ..... 345/74, 75, 2, 345/22, 153, 155, 131, 128, 42, 47, 55, 88, 72, 150, 147, 74.1; 313/495, 496, 497, 504, 506, 507

[56] References Cited

U.S. PATENT DOCUMENTS

| | | | |
|---|---|---|---|
| 4,326,150 | 4/1982 | Kobayashi | 345/22 |
| 4,673,252 | 6/1987 | Kugo et al. | 345/88 |
| 4,831,369 | 5/1989 | Lecourtier | 345/128 |
| 4,965,564 | 10/1990 | Fabry et al. | 345/88 |
| 5,091,718 | 2/1992 | Beatty | 345/22 |
| 5,225,820 | 7/1993 | Clerc | 345/55 |
| 5,402,143 | 3/1995 | Ge et al. | 345/75 |
| 5,655,940 | 8/1997 | Hodson et al. | 345/42 |
| 5,773,927 | 6/1998 | Zimlich | 313/495 |

*Primary Examiner*—Dennis-Doon Chow
*Attorney, Agent, or Firm*—Dorsey & Whitney LLP

[57] ABSTRACT

A display includes a screen having a first region of a color light emissive material and a second region of a monochrome material. In one embodiment, the color light emissive material is formed from triads of red, green and blue triads of subregions. A first set of emitters grouped in threes is aligned to the first region and a second set of emitters is aligned to the second region. The first set of emitters is driven by red, green, and blue components of a color image signal to produce a multicolor display. The second set of emitters is driven by a monochrome image signal to produce a monochrome display. In a display assembly according to the invention, the first and second sets of emitters are incorporated on a common substrate. The first set of emitters forms a fixed text subdisplay and the second set of emitters is arranged as a conventional matrix addressable array. The matrix addressable array provides video, graphical or textual information and the subdisplay provides textual, fixed-shaped graphical, numerical or color-coded information.

37 Claims, 3 Drawing Sheets

COMBINED MONOCHROME AND COLOR DISPLAY

STATEMENT AS TO GOVERNMENT RIGHTS

This invention was made with government support under Contract No. DABT-63-93-C-0025 by Advanced Research Projects Agency (ARPA). The government has certain rights to this invention.

TECHNICAL FIELD

The present invention relates to image display devices and, more particularly, to display devices having segmented display regions.

BACKGROUND OF THE INVENTION

Flat panel displays are widely used in a variety of applications, including computer displays. One suitable flat panel display is a field emission display. Field emission displays typically include a generally planar baseplate positioned beneath a faceplate. The baseplate includes a substrate having an array of surface discontinuities projecting from an upper surface. Conventionally, the surface discontinuities are conical projections, or "emitters" integral to the substrate. Contiguous groups of emitters may be grouped into emitter sets where the bases of the emitters in the emitter sets are commonly connected.

Typically, the emitters are arranged in an array of rows and columns, and a conductive extraction grid is positioned above the emitters. All, or a portion, of the extraction grid is driven with a voltage of about 30–120 V. The emitters are then selectively activated by applying a voltage to the emitters. The voltage difference between the emitters and the extraction grid produces an electric field extending from the extraction grid to the emitters. In response to the electric field, the emitters emit electrons.

The faceplate is mounted directly above the extraction grid, and includes a transparent display screen coated with a transparent conductive material to form an anode biased to about 1–2 kV. The anode attracts the emitted electrons. A cathodoluminescent layer covers the anode and faces the extraction grid to intercept the electrons as they travel toward the 1–2 kV potential of the anode. The electrons strike the cathodoluminescent layer, causing the cathodoluminescent layer to emit light at the impact site. The emitted light then passes through the anode and display screen where it is visible to a viewer. The light emitted from each of the areas thus becomes all or part of a picture element or "pixel." To individually control each of the pixels, current through each emitter or group of emitters is selectively controlled by a row signal and column signal through corresponding drive circuitry. To create an image, the control circuitry separately establishes current to each of the emitters or emitter sets.

The characteristics of the light produced in response to the emitted electrons depends, in part, upon the properties of the cathodoluminescent layer. For example, the cathodoluminescent layer may include a phosphor material that emits light over a wide range of wavelengths simultaneously. In some instances, substances are added to the phosphor material to control the wavelengths of emitted light thereby producing light of a desired color. One skilled in the art will recognize that a wide choice of colors are available. Where either of these types of materials contiguously coat a display region, images are produced by variations in light intensity at each pixel, disregarding chrominance information. Material for displaying images without color variations, such as material that substantially contiguously coats a region, will be referred to herein as a monochrome material. One skilled in the art will recognize that the term "monochrome" may refer to a single color material that emits over a narrow range of wavelengths or a full spectrum material that simultaneously emits over a wide range of wavelengths. For example, screens for black and white televisions emit full spectrum light at selected gray levels while screens in night vision goggles typically utilize green monochrome material.

Often, a cathodoluminescent layer will include several discrete subregions of color materials or "subpixels." Typically, such subregions are grouped into threes or "color triads" which include a red, a green and a blue subregion. Such screens can emit a variety of colors depending upon the relative activation levels of the red, green and blue subregions. Such relative activation levels are typically controlled in response to chrominance information in a video signal. Materials having selectable color emissions will be referred to herein as "color materials." It will be understood that such color materials typically include more than one type of material, such as triads of red, green and blue subregions.

SUMMARY OF THE INVENTION

A faceplate includes a display screen coated with a light emissive layer that has separate regions of respective light emissive materials, where the properties of the respective light emissive materials are selected according to the information to be displayed. In a display device according to one embodiment of the invention, the screen includes a transparent anode facing a baseplate beneath the regions of light emissive material. The baseplate includes a substrate on which emitters are mounted, and an extraction grid is positioned over the emitters. The extraction grid is biased to about 30–120V, and the anode is biased to about 1–2 kV.

Electronic circuitry allows emitters in the substrate to be connected to a reference potential, such as ground. The voltage difference between the extraction grid and the grounded emitters produces an intense electric field extending from the extraction grid to the emitters. The electric field extracts electrons, and the high anode voltage draws the extracted electrons upwardly to strike the cathodoluminescent layer. In response, the cathodoluminescent layer emits light in the region near the impact sight.

To allow the same screen to operate more effectively for more than one application or image, the screen is segmented into regions where the cathodoluminescent material in each region has properties selected according to the type of image or image portion to be displayed. For example, where a warning indicator is desired, the material may be a red monochrome emissive material. Where a bright, high resolution image is desired, the material may be a high efficiency monochrome material. Where chrominance information is desired, the region may include red, green and blue subregions. Consequently, different images presented in the different regions each employ a respective light emissive material.

In one embodiment, a first region of the cathodoluminescent layer is segmented into red, green, and blue subregions, each aligned to a corresponding emitter or set of emitters. The emitters aligned with each subregion are controlled separately so that a range of colors can be produced by selectively activating the emitters aligned with each colored subregion. A second region of the cathodoluminescent material is a contiguous monochrome material and is aligned with a conventional array of emitter sets. The monochrome material has a high contrast ratio and allows finer resolution and sharper edges than the color material of the first region. The monochrome second region is used to display video or graphical information while the color first region displays application-specific images, such as warning images or symbols, multi-segment displays, multicolor lighting, warning or backlit text.

DETAILED DESCRIPTION OF THE INVENTION

Figure 1:
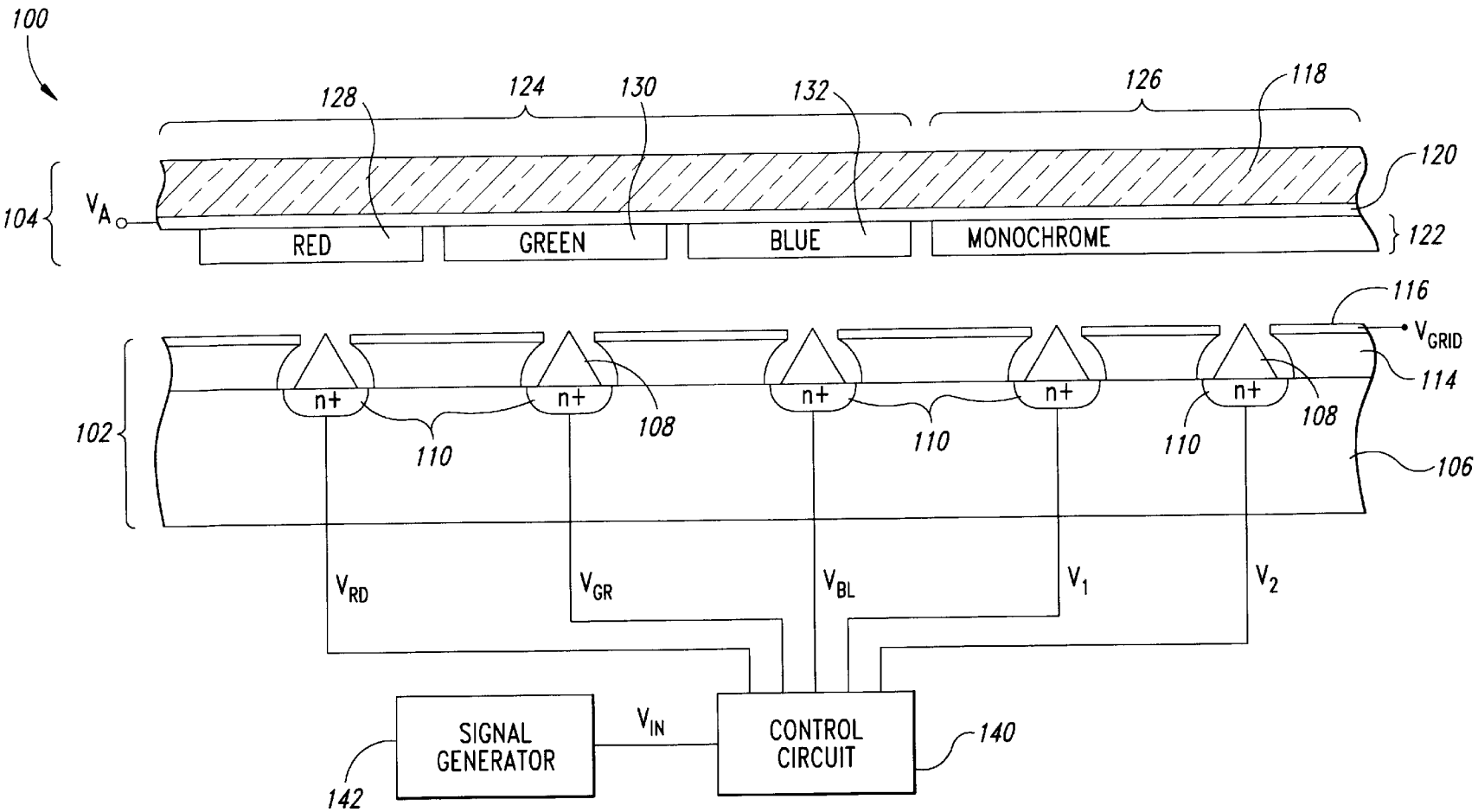
FIG. 1 is a side cross-sectional view of a portion of a field emission display according to a preferred embodiment of the invention showing three spaced apart emitters beneath a display screen, where the screen includes a first region having red, green, and blue subregions and a second region of monochrome material.

As shown in FIG. 1, a field emission display 100 includes baseplate 102 beneath a faceplate 104. The baseplate 102 includes a substrate 106 preferably formed of glass, and has five emitters 108 projecting from its upper surface. While only five emitters 108 are shown in FIG. 1 for clarity of presentation, one skilled in the art will recognize that the substrate 106 may include many more than five emitters 108, depending upon the application. Also, although the emitters 108 are each represented by a single conical emitter, one skilled in the art will recognize that several such emitters 108 are typically grouped into commonly connected emitter sets.

An insulative layer 114 of a conventional dielectric material is deposited on the substrate 106 around the emitters 108. The upper surface of the insulative layer 114 carries a conductive extraction grid 116. The insulative layer 114 and extraction grid 116 include mutually aligned holes into which the emitters 108 project.

The faceplate 104 is positioned above the emitters 108 and the extraction grid 116 and includes a glass display screen 118 having its inner surface coated with a conductive, transparent material to form an anode 120. A cathodoluminescent layer 122 coats the lower surface of the anode 120.

The cathodoluminescent layer 122 is segmented into two regions 124, 126. The first region 124 is a color region formed from separate subregions 128, 130, 132 of red, green, and blue light emissive materials, respectively. The second region 126 is formed from a monochrome emissive material that has a high range of light emissivity and is formulated for high resolution.

To fabricate the faceplate 104, the display screen 118 is first coated with the conductive, transparent material according to conventional techniques. Then, the red, green, and blue emissive materials are each deposited and patterned separately using conventional color screen deposition techniques, such as electrophoresis, and conventional color screen photolithographic processes, such as lift-off or positive resist techniques. Next, the color first region 124 is masked with a thick contiguous protective coat of photoresist. Then, the monochrome material is conventionally deposited and patterned to produce the second region 126. Finally, the protective coat of photoresist is removed.

The patterns of the materials will depend upon the particular application of the display 100, as will be described below. Typically, the red, green and blue emissive materials will be grouped into color triads of red, green and blue subregions 128, 130, 132 with a plurality of such triads occupying a contiguous area, as will be described below. The red, green and blue subregions 128, 130, 132 may be circular, rectangular, or any other suitable shape.

Each of the subregions 128, 130, 132 is aligned with a respective emitter 108 or group of emitters 108 so that each of the subregions 128, 130, 132 can be activated independently. The second region 126 is aligned with an array of rows and columns of selectively activatable emitters 108 that can each supply electrons to a respective section of the second region 126.

In operation, the extraction grid 116 is biased to a grid voltage $V_{Grid}$ of about 30–120 V and the anode 120 is biased at a high voltage $V_A$, such as 1–2 kV. If selected ones of the emitters 108 are connected to a voltage much lower than the grid voltage $V_{Grid}$, such as ground, the voltage difference between the extraction grid 116 and the emitters 108 produces an intense electric field between the emitters 108 and the extraction grid 116. The electric field causes the emitters 108 to emit electrons according to the Fowler-Nordheim equation. The emitted electrons are attracted by the high anode voltage $V_A$ and travel toward the anode 120 where they strike the region 124 or 126 of cathodoluminescent layer 122 to which the activated emitter 108 is aligned. The electrons cause the cathodoluminescent layer 122 to emit light around their impact sites. The emitted light passes through the transparent anode 120 and the display screen 118 where it is visible to an observer.

Properties of the emitted light, such as the wavelength, will depend upon the formulation of the particular region 124, 126 of the cathodoluminescent layer 122 struck by the electrons. For example, when electrons strike the second region 126, the emitted light will include a wide range of wavelengths, because the material in the second region 126 is full spectrum monochrome emissive. Similarly, when electrons strike the red subregion 130, the emitted light will principally include red wavelengths.

Another property of the emitted light affected by the type of cathodoluminescent layer 122 is the intensity. For example, full spectrum monochrome phosphors typically emit more light energy for a given level of excitation than color phosphors. Consequently, the brightness level of the monochrome second region 126 can be made brighter than that of the color first region 124 for a given rate of electron excitation.

A further property of the emitted light that can be affected by the type of cathodoluminescent layer 122 is the resolution. Monochrome phosphors can be made with a higher resolution because of several factors including the relative grain sizes of color and monochrome phosphors, the minimum pixel size defined by the triad of color subregions 128, 130, 132, and edge effects due to interleaving of the subregions 128, 130, 132.

The intensity of light emitted by each subregion 128, 130, 132 or part of the second region 126 is a function of the rate at which electrons are emitted by the emitters 108 aligned with the subregion 128, 130, 132 or part of the second region 126. The rate at which the emitters 108 emit electrons depends, in turn, upon the current flowing to the emitters 108. Thus, the intensity of the emitted light from each subregion 128, 130, 132 or part of the second region 126 can be controlled by controlling current flow to the emitters 108 aligned with the subregion 128, 130, 132 or part of the second region 126.

To control the current flow, a current control circuit 140 establishes the emitter currents in response to one or more input signals $V_{IN}$ which are provided from a signal generator 142 external to the display 100. The current control circuit 140 controls current flow to the emitters 108 by controlling the voltages of the n+ regions 110 or controlling the current available to the n+ regions 110. A variety of current control circuits 140 are known.

One skilled in the art will recognize that some or all of the components of the current control circuit 140 may also be integrated into or onto the substrate 106. Alternatively, the current control circuit 140 can be separate from the substrate 106. One skilled in the art will also recognize several circuits and methods for controlling the current flow through the emitters 108. For example, the emitters 108 can be coupled directly to ground, and the intensity of light can be controlled by locally varying the grid voltage $V_{Grid}$. Alternatively, the emitters 108 can be driven by binary signals having variable duty cycles.

The leftmost three emitters 108 are aligned with the corresponding red, green, or blue emissive subregions 128, 130, 132 of the first region 124 and are driven, respectively, by red, green, and blue signal components $V_R$, $V_G$, $V_B$ in response to chrominance information in the input signal $V_{IN}$. The red, green or blue emissive subregions 128, 130, 132 can thus be activated separately to produce red, green or blue light. As is known, red, green and blue emissive sources can be combined to produce a color display where the color is determined by the relative intensities of the red, green, and blue light. The first region 124 can therefore emit various colors, as determined by the components $V_R$, $V_G$, $V_B$ of the input signal $V_{IN}$. Because the first region 124 selectively emits more than one color, it will be referred to herein as a color region, and the material of the first region 124 of the cathodoluminescent layer 122 will be referred to as a color material.

The second region 126 emits light at various gray scale levels without regard to chrominance information. The second region 126 is activated by a matrix addressable emitter array as will be described below, with respect to FIGS. 3 and 4. The second region 126 therefore exemplifies a monochrome region.

Figure 2:
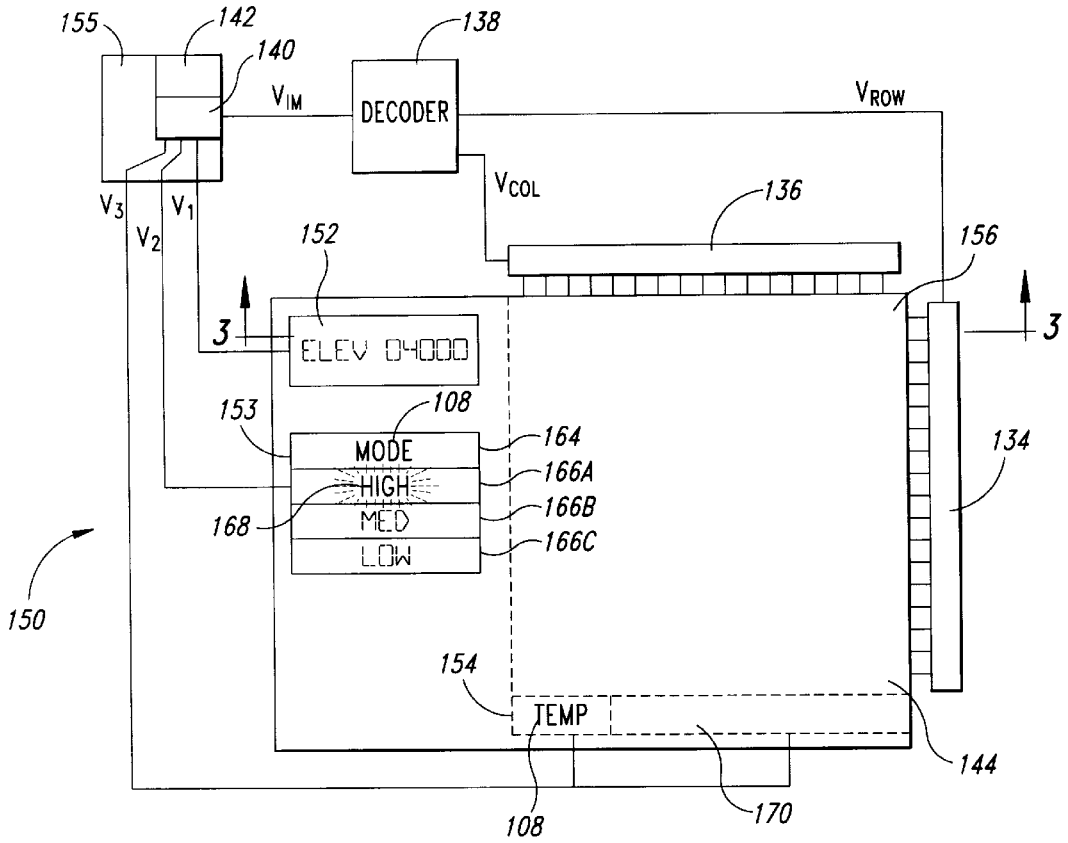
FIG. 2 is a top plan view of an embodiment of the invention including a monochrome main display and three color subdisplays where the subdisplays are driven by circuitry separate from that of the main display.
Figure 3:
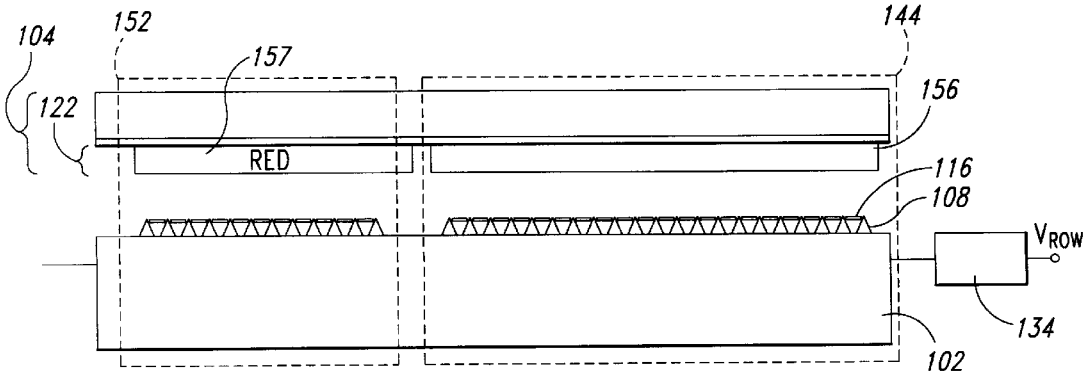
FIG. 3 is a side elevational view of the field emission display of FIG. 2 cross sectioned along a line 3—3, showing a color region of the cathodoluminescent layer for one of the subdisplays and a monochrome region for the main display.

FIGS. 2 and 3 show an embodiment of a display apparatus 150 including the faceplate 104 that operates under control of a central command unit 155 which includes the control circuit 140 and the signal generator 142. In this embodiment, the faceplate 104 is divided such that a monochrome image region 156 forms a main display 144 (FIG. 3) on a common screen with three subdisplays 152–154.

The main display 144 displays video or similar images such as a traveling map, video image, graphical representation of terrain, video representation of a combat environment, or other images representable by video or similar signals. The main display 144 is activated by a conventional matrix array of rows and columns of emitters 108 driven by a video or similar image signal $V_{IM}$. Conventional row and column drivers 134, 136 driven by a decoder 138 in response to the image signal $V_{IM}$ selectively activate the emitters 108 beneath the monochrome image region 156, thereby processing the desired video or similar image.

The subdisplays 152–154 provide application-specific supplemental information in response to respective control signals $V_1$–$V_3$ from the central command unit 155. The subdisplays 152–154 are formed from groups of emitters 108 aligned with respective color or monochrome regions, as described below. The emitters 108 in each group can be activated simultaneously to allow presentation of a fixed shape or simple object with less complex driving circuitry than that of the matrix array.

The uppermost subdisplay 152 includes nine separate eleven-segment displays, each formed from eleven groups of emitters 108. All nine of the groups of emitters 108 are aligned with a red emissive region of the cathodoluminescent layer 122. The eleven segments in each display can be selectively activated to display numbers or text. For example, as shown, the eleven-segment displays are each activated to form a separate letter or number in the text "ELEV 04000." As best seen in FIG. 3, the cathodoluminescent layer 122 in the uppermost subdisplay is formed from a red emissive material 157 such that the uppermost subdisplay 152 provides a changeable, single color, light-emitting textual image.

Beneath the uppermost subdisplay 152, a second subdisplay 153 includes a text-based portion 164 and three backlit portions 166A–C where the uppermost backlit portion 166A is active. The text-based portion 164 includes four letter-shaped groups of emitters 108 beneath a monochrome region of the cathodoluminescent layer 122 to display the word "MODE." The backlit portions 166A–C include groups of emitters 108 arranged in blocks that, when active, activate respective monochrome regions of the cathodoluminescent layer 122. As shown, the uppermost backlit portion 166 is activated to produce the backlit text 168 spelling the word "HIGH." The respective regions of the cathodoluminescent layer 122 are formulated to produce red, yellow and green light, respectively, such that the three backlit portions 166A–C are color-coded. The second subdisplay 153 thus provides a combination of backlit text and/or graphical information and a fixed light-emitting textual heading.

Immediately beneath the main display 144, a third subdisplay 154 includes four groups of emitters 108 arranged to spell "TEMP" and a multicolor portion 170. The text shaped group of emitters 108 is similar to the groups of emitters 164 described above. The multicolor portion 170 includes triads of emitters 108 to allow the multicolor portion 170 to change colors to indicate safe, warning, or fail conditions. The third subdisplay 154 thus includes a color region (i.e., the multicolor portion 170) having a selectable color.

One skilled in the art will recognize that the structure of the screen 104 can vary virtually limitlessly, depending upon the application. For example, while the faceplate 104 as presented in FIGS. 2 and 3 is configured for use as a display for aerospace applications, one skilled in the art will recognize various other combinations of color and monochrome regions 124, 126. For example, the monochrome second region 126 may display images for a portable personal computer and the subdisplays 152–154 can provide various operating information, such as battery level, modem connection or similar features. Similarly, the subdisplays 152–154 can be rearranged to form other types of information displays, such as automobile dashboard panels or stereo control panels. Alternatively, the conventional array of the monochrome region 156 may be a portion of a touch screen display and the subdisplays 152–154 can indicate touch locations for activating specific features or for providing input. As a further alternative, the monochrome region 156 may be replaced by a color region while the subdisplays 152–154 may be monochrome subdisplays. Such a configuration would be particularly suitable where resolution of the subdisplays 152–154 was critical.

Figure 4:
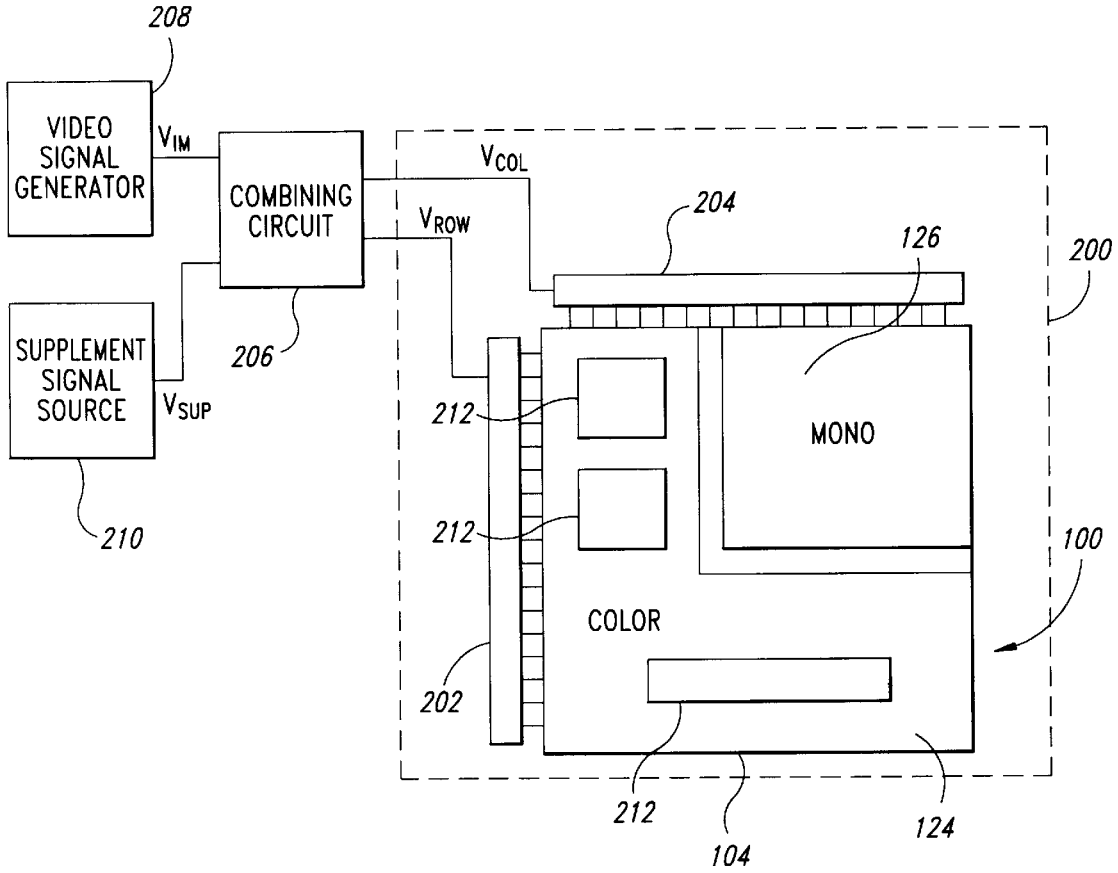
FIG. 4 is a top plan view of an embodiment of the invention including a monochrome main display and three color subdisplays all driven by common row and column drivers.

FIG. 4 shows another embodiment of a display apparatus 200 incorporating the display 100 of FIG. 1. Unlike the display apparatus 150 of FIG. 3, an array of rows and columns of emitters 108 extends substantially across the entire substrate 106. Corresponding row and column drivers 202, 204 include row and column outputs coupled to the rows and columns of the array. Thus, the row and column drivers 202, 204 activate both the color first region 124 and the monochrome second region 126 of the screen 104. The entire display area can thus be addressed through a common matrix addressing approach.

The row and column drivers 202, 204 receive respective signals from a combining circuit 206 driven by a video signal generator 208 and a supplemental signal source 210. The video signal generator 208 provides an image signal $V_{IM}$ representing images to be displayed on the monochrome main display 144. The video signal generator 208 may be a television receiver, VCR, camcorder, computer, night vision imaging system, or other device for producing an image signal. The supplemental signal source 210 provides a supplemental signal $V_{SUP}$ that represents color image information for activating supplemental information blocks 212 in the color first region 124. The supplemental signal $V_{SUP}$ can represent any information to be displayed outside of the main display 144. For example, the supplemental signal $V_{SUP}$ may represent outputs of temperature, speed, or battery monitors or status information. The combining circuit 206 combines the image signal $V_{IM}$ from the video signal source 208 and the supplemental signal $V_{SUP}$ from a supplemental source 210 to provide row and column signals $V_{ROW}$, $V_{COL}$ to the row and column drivers 202, 204, respectively. The combining circuit 206 can be any suitable combining circuit, such as a multiplexer. The row and column drivers 202, 204 are conventional row and column drivers for a field emission display, such as shift registers and corresponding sampling and gating circuits.

Based upon the row and column signals $V_{ROW}$, $V_{COL}$, the row and column drivers 202, 204 activate selected rows of extraction grids 116 and columns of the emitters 108 to produce the appropriate images in each of the regions 124, 126. For example, the monochrome main display 144 provides video images and the supplemental information blocks 212 provide supplemental information, such as battery condition, temperature, altitude, etc. Such combination of signals for activating a display can be used in a variety of applications. For example, video games often include textual regions near the perimeter to indicate status and score of the game. Similarly, video displays often include on-screen programming information in predefined regions of the screen in addition to ongoing presentation of video images.

While the present invention has been presented by way of exemplary embodiments, one skilled in the art will recognize several modifications which may be within the scope of the invention. For example, although the preferred embodiment of the display apparatus 150 employs electron emitters 108, other structures for activating the faceplate 104, such as plasma display elements, may also be within the scope of the invention. Also, although the emitters 108 are described herein as being formed on a glass substrate 108, the substrate 108 can be formed of silicon. In such an embodiment, n+ regions 110 below each emitter 108 in the substrate 106 allow electrical connection to the respective emitters 108, as will be described below. The emitters 108, n+ regions 110, insulative layer 114, and extraction grid 116 can be formed using conventional field emission display fabrication techniques. Although the first and second regions 124, 126 have been described herein as color and monochrome regions, respectively, the first region 124 may be a monochrome region and the second region 126 may be a color region for some applications. Accordingly, the invention is not limited except as by the appended claims.

What is claimed is:

1. A screen assembly for displaying an image including monochrome and color image portions, comprising:

a transparent plate;

a transparent conductive anode on a first surface of the plate;

a first light emissive layer covering a first portion of the anode, the first light emissive layer including a monochrome cathodoluminescent material; and a second light emissive layer covering a second portion of the anode the second light emissive layer including a color cathodoluminescent material operable to selectively emit light in a first wavelength range in response to a first excitation signal and to emit light in a second wavelength range in response to a second excitation signal.

2. The screen assembly of claim 1 wherein the color cathodoluminescent material of the second light emissive layer includes a plurality of separate materials at respective interstitial locations.

3. The screen assembly of claim 1 wherein the color cathodoluminescent material includes a triad of discrete red, green and blue subregions formed from respective red, green and blue emissive materials.

4. The screen assembly of claim 1 wherein the first portion defines a substantially contiguous block.

5. A display for displaying an image including monochrome and color image portions, the color image portion having a selected pixel size, comprising:

a screen assembly including a light emissive layer, the light emissive layer including a first light emissive region of a monochrome cathodoluminescent material and a second light emissive region of a color cathodoluminescent material;

an electron-emitting assembly facing the screen assembly, wherein a first portion of the electron-emitting assembly is aligned with the first light emissive region and a second portion of the electron-emitting assembly is aligned with the second light emissive region; and a driving circuit having a monochrome output coupled to the first portion of the electron-emitting assembly and a color output coupled to the second portion of the electron-emitting assembly.

6. The display of claim 5 wherein the electron-emitting assembly includes an emitter substrate having a plurality of electron emitters disposed thereon.

7. The display of claim 6 wherein the driving circuit includes an integrated control circuit coupled to control electron emission from the emitters, the control circuit being integrated into the emitter substrate.

8. The display of claim 5 wherein the color cathodoluminescent material includes a plurality of discrete subregions, each smaller than the selected pixel size.

9. The display of claim 8 wherein each of the subregions includes a respective one of a red, a green and a blue emissive material.

10. The display of claim 5 wherein the second light emissive region is configured to display textual information.

11. A field emission display for producing first and second discrete, independent image portions, comprising:

an emitter substrate having a contiguous first emitter section defining a first area for displaying the first image portion, and a second contiguous emitter section defining a second area for displaying the second image portion; and a display screen having a cathodoluminescent layer, the cathodoluminescent layer having a first region of a first monochrome emissive material aligned with the first emitter section and a second region adjacent the first region of a second color emissive material aligned with the second emitter section.

12. The display of claim 11, including a control circuit coupled to the emitter substrate.

13. The display of claim 12 wherein the control circuit includes a first output coupled to the first emitter section and a second output separately coupled to the second emitter section.

14. The display of claim 11 wherein the control circuit includes a combining circuit operative to receive a first signal representing the first image portion and a second signal representing the second image portion, wherein the combining circuit is further operative to produce a combined signal representing both the first and second image portions.

15. The display of claim 11 wherein the first material is selected to emit light at a first wavelength and the second material is selected to emit light at a second wavelength different from the first wavelength.

16. The display of claim 11, further comprising a third emitter section aligned to the display screen, wherein the cathodoluminescent layer includes a third region aligned to the third emitter section, the third region including a material selected to emit light at the third wavelength different from the first and second wavelengths.

17. The display of claim 16 wherein the material of the third region is a monochrome material.

18. The display of claim 17 wherein the first image portion is a video image.

19. The display of claim 18 wherein the second image portion is a fixed display.

20. The display of claim 18 wherein the second image portion is a graphical image.

21. A display apparatus for displaying at least one image having a selected pixel size, comprising:

a signal generator;

a screen assembly including a light emissive layer, the light emissive layer including a first light emissive region of a monochrome cathodoluminescent material and a second light emissive region having first and second other cathodoluminescent materials patterned into a plurality of subregions, each subregion defining an area smaller than the selected pixel size, each subregion including a respective one of the first and second other cathodoluminescent materials;

an electron-emitting assembly facing the screen assembly, wherein a first portion of the electron-emitting assembly is aligned with the first light emissive region and a second portion of the electron-emitting assembly is aligned with the second light emissive region, the second portion including a plurality of electron emitters each aligned with a respective one of the subregions and configured for selective activation of the respective subregion; and a driving circuit having a monochrome output coupled to the first portion of the electron-emitting assembly and a color output coupled to the second portion of the electron-emitting assembly, the driving circuit having an input coupled to the signal source.

22. The display apparatus of claim 21 wherein the first and second other cathodoluminescent materials are grouped in pairs, each pair corresponding to a respective pixel.

23. The display apparatus of claim 22 wherein the video signal generator includes a night vision imaging system.

24. The display apparatus of claim 22 wherein the video signal generator includes a camcorder.

25. The display apparatus of claim 22 wherein the video signal generator includes a television receiver.

26. The display apparatus of claim 22 wherein the video signal generator includes a video cassette recorder.

27. The display apparatus of claim 22 wherein the video signal generator is a computer.

28. The display apparatus of claim 22 wherein the electron-emitting assembly includes an emitter substrate.

29. The display apparatus of claim 28 wherein the first and second portions are included within a single array of rows and columns.

30. A method of displaying information with a display device including a cathodoluminescent layer having a first section of a color material and a second section of a monochrome material, comprising the steps of:

producing a color image portion including chrominance information by selectively activating the first section of the cathodoluminescent layer; and producing a monochrome image portion excluding chrominance information by activating the second section of the cathodoluminescent layer.

31. The method of claim 30 wherein the information is color information, further including the steps of:

providing a third section of the screen assembly having a third cathodoluminescent material different from the color and monochrome materials; and activating the third section of the cathodoluminescent layer to produce a third image portion.

32. The method of claim 30 wherein the display includes a matrix addressable array of emitters, wherein the step of producing a color image portion including chrominance information includes the step of activating selected emitters in the matrix addressable array to produce video, graphical, or textual images including chrominance information.

33. The method of claim 30 wherein the display includes a matrix addressable array of emitters, wherein the step of producing a monochrome image portion includes the step of activating selected emitters in the matrix addressable array to produce video, graphical, or textual images.

34. A method of displaying information with a field emission display having a plurality of emitters and a cathodoluminescent layer including a plurality of discrete sections wherein a first of the sections includes a first monochromatic emissive material selected to emit light in a first range of wavelengths and a second of the sections includes a second color emissive material selected to emit light in a second range of wavelengths different from the first range of wavelengths, comprising the steps of:

aligning a first set of the emitters with the first section;

aligning a second set of the emitters with the second section;

activating the first set of emitters to produce a first image in the first range of wavelengths; and activating the second set of emitters to produce a second image in the second range of wavelengths.

35. The method of claim 34 wherein the cathodoluminescent layer includes a third section including a third monochromatic material selected to emit light in a third range of wavelengths different from the first and second ranges of wavelengths, further including the steps of:

aligning a third set of the emitters to the third section; and selectively activating the third set of emitters to produce a third image in the third range of wavelengths.

36. A method of producing a display screen having a selected pixel size, comprising:

providing a transparent plate;

providing a first monochromatic light emissive coating selected to emit light in a fixed range of wavelengths;

covering a first region of the plate with the first monochromatic light emissive coating;

providing a second color light emissive coating selected to emit light in a variable range of wavelengths; and covering a second region of the plate with the second color light emissive coating.

37. The method of claim 36 wherein the second color light emissive coating includes a plurality of light emissive materials, each having a selected wavelength range, wherein the step of covering a second region of the plate with the second color light emissive coating comprises the steps of:

segmenting the second region into a plurality of subregions, wherein each subregion is smaller than the selected pixel size; and applying each of the light emissive materials to a respective subregion.

* * * * *